US009162277B2

(12) United States Patent
Flis et al.

(10) Patent No.: US 9,162,277 B2
(45) Date of Patent: Oct. 20, 2015

(54) INDEXING SELF-PIERCING DIE RIVETER

(71) Applicant: Ford Motor Company, Dearborn, MI (US)

(72) Inventors: Matthew Flis, Dearborn, MI (US); William C. Moision, Northville, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 190 days.

(21) Appl. No.: 13/769,581

(22) Filed: Feb. 18, 2013

(65) Prior Publication Data

US 2014/0230242 A1 Aug. 21, 2014

(51) Int. Cl.

| | |
|---|---|
| ***B21J 15/28*** | (2006.01) |
| ***B21J 15/02*** | (2006.01) |
| ***B21J 15/10*** | (2006.01) |
| ***B21J 15/36*** | (2006.01) |

(52) U.S. Cl.

CPC ..... *B21J 15/28* (2013.01); *B21J 15/025* (2013.01); *B21J 15/10* (2013.01); *B21J 15/36* (2013.01); *Y10T 29/49943* (2015.01); *Y10T 29/5307* (2015.01); *Y10T 29/5343* (2015.01); *Y10T 29/5377* (2015.01)

(58) Field of Classification Search

CPC ..... B21J 15/28; B21J 15/10; B21J 15/36; B21J 15/025; Y10T 29/5343; Y10T 29/5307; Y10T 29/5377; Y10T 29/49943

USPC ..... 29/798, 524.1, 796, 716, 243.53, 432.2; 72/115, 448, 473, 481.5; 227/61, 105

See application file for complete search history.

(56) References Cited

U.S. PATENT DOCUMENTS

| | | | | |
|---|---|---|---|---|
| 1,336,529 | A * | 4/1920 | Lundmark | 83/167 |
| 3,611,773 | A * | 10/1971 | Gerth | 72/115 |
| 6,964,094 | B2 | 11/2005 | Kondo | |
| 7,555,833 | B2 | 7/2009 | Wang et al. | |
| 7,559,133 | B2 | 7/2009 | Chitty et al. | |
| 7,810,231 | B2 | 10/2010 | Naitoh | |
| 2001/0016973 | A1 | 8/2001 | Speller, Jr. et al. | |
| 2011/0277288 | A1 | 11/2011 | Wendt et al. | |

FOREIGN PATENT DOCUMENTS

| | | |
|---|---|---|
| EP | 1163963 A1 | 12/2001 |
| GB | 834066 | 5/1960 |

OTHER PUBLICATIONS

Great Britain Search Report, for corresponding Great Britain application No. GB1400731.4, dated Oct. 6, 2014.

* cited by examiner

*Primary Examiner* — John C Hong

(74) *Attorney, Agent, or Firm* — Raymond L. Coppiellie; Brooks Kushman P.C.

(57) ABSTRACT

A self-piercing die riveter having an indexable die table on the nose of its frame. The die table has a number of dies disposed thereon. The frame defines a first passage and a second passage in communication with and diverging from the first passage. An actuator for indexing the die table is located on the riveter outside of the nose of the frame and is connected to the die table through either shafts or belts disposed within the first and second passages. The die table has a number of detents that cooperate with a locating arm to hinder indexing of the die table and position the dies in-line with the path of a reciprocating punch.

19 Claims, 3 Drawing Sheets

INDEXING SELF-PIERCING DIE RIVETER

TECHNICAL FIELD

This disclosure relates to self-piercing die riveters, specifically with respect to multiple self-piercing dies that may be indexed in and out of position during use.

BACKGROUND

Self-piercing die riveters have been used to join two or more materials to each other using self-piercing rivets. The materials to be joined are placed between a punch and die of the riveter. The punch contacts the self-piercing rivet at the head and drives the tail towards the die piercing the materials. The self-piercing rivet fully pierces the top sheet material(s) but typically only partially pierces the bottom sheet providing a tight joint. With the influence of the die, the tail end of the rivet flares and interlocks into the bottom sheet forming a low profile button.

Self-piercing rivets are typically fed into position on the riveter from a tape, cassette or spool for continuous production. Self-piercing rivets may be used to join a range of dissimilar materials such as steel, aluminum, plastics, composites and pre-coated or pre-painted materials. Benefits of self-piercing die riveting include low energy demands, no heat, no fumes, no sparks, no waste and very repeatable quality.

Single die riveters have replaceable dies that are slid in and out of a die receiving hole. The die receiving hole is located directly beneath the die and subsequently directly in-line with the punch motion. Having a hole in-line with the punch increases the amount of stress risers and generally requires a need to reinforce the frame of the riveter in that area. Reinforcing the frame near the die requires a larger nose of the frame which limits accessibility of the tool. As well, single die riveters do not have the flexibility to easily change out varying die shapes to allow for a single die riveter to be used with multiple die configurations.

Examples of indexing die riveters having an indexing motor located on the nose of the frame may be found in U.S. Pat. No. 6,964,094 B2 to Kondo and U.S. Pat. No. 7,810,231 B2 to Naitoh. Having indexing motors located on the nose of the frame limits the access of the tool.

The above problem(s) and other problems are addressed by this disclosure as summarized below.

SUMMARY

One aspect of this disclosure is directed to a self-piercing die riveter having a frame that supports a die table. The die table is rotatable on an axis of rotation and has a number of dies disposed there around. The frame defines a first passage extending along an axis of rotation of the die table and a second passage in communication with and diverging from the first passage. An actuator is connected to the die table and is capable of rotating the die table through the first and second passages.

According to another aspect of this disclosure, a die riveter has a die table disposed on the nose of its frame. The die table is rotatable on an axis with a first shaft connected to and extending from the die table along the axis of rotation. A second shaft is coupled to and extends in a diverting direction from the first shaft. An actuator is connected to the second shaft and is capable of rotating the die table through the first and second shafts.

According to a further aspect of this disclosure, a riveter is disclosed that has a die table connected defining a number of detents. A first die is disposed on the die table corresponding to a first detent. A locating arm is connected to the riveter having a free end selectively disposed in the first detent to hinder indexing of the die table and positioning the first die in-line with the path of a reciprocating punch.

The above aspects of this disclosure and other aspects will be explained in greater detail below with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
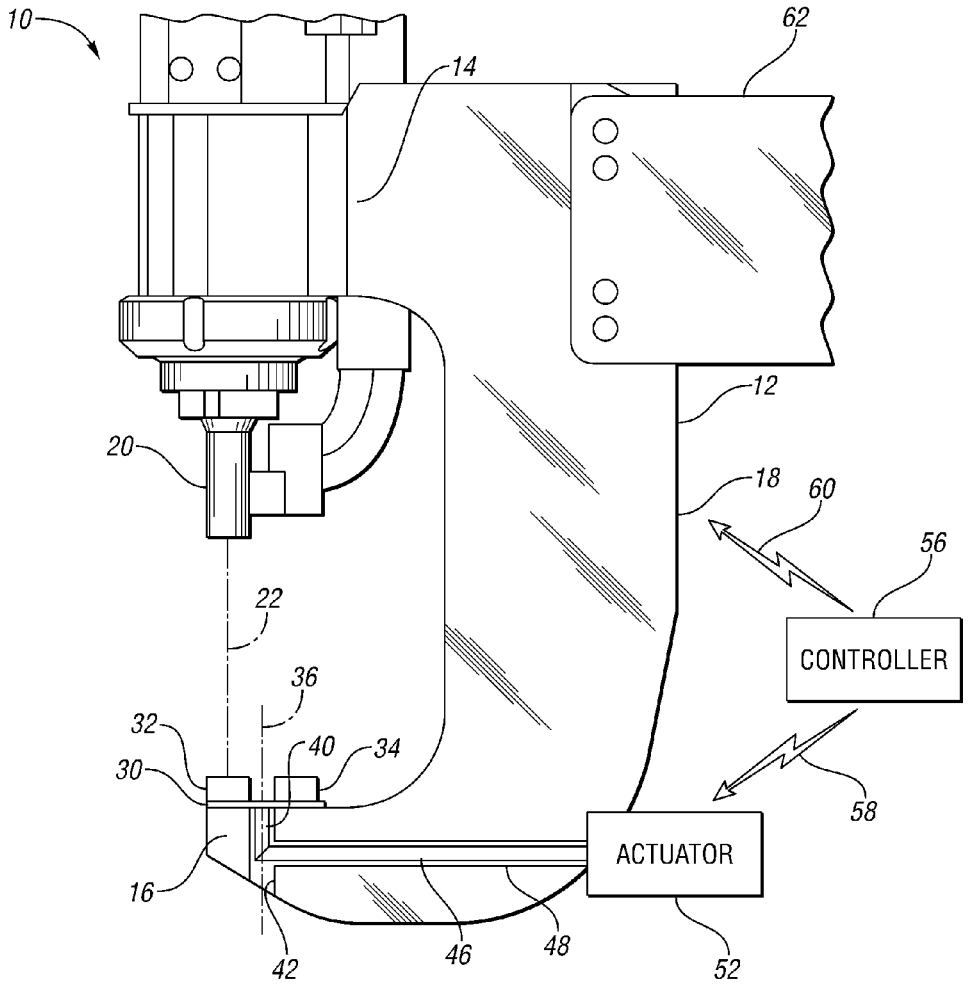
FIG. 1 is a diagrammatic side view of a die table on a nose of a frame of a self-piercing die riveter, an actuator disposed on the riveter away from the nose, and the coupling of the actuator to the die table through shafts disposed in passages of the frame.

FIG. 1 shows a self-piercing die riveter 10 with a frame 12. The frame 12 may be generally C-shaped defining a head 14, a nose 16, and a central section 18 disposed between the head 14 and the nose 16. A punch 20 is connected to and supported by the head 14 of the frame 12. The punch 20 is a reciprocating punch and reciprocates along a path 22 from the head 14 to the nose 16 of the frame 12. Materials (not shown) may be joined together using the self-piercing die riveter 10 by placing the materials between the head 14 and nose 16 of the frame 12 within the punch reciprocation path 22 and a rivet (not shown) may be driven into the materials by the punch 20. Materials to be joined may have varying geometries and access points. The shape of the nose 16 of the frame 12 is the greatest limiting factor for being able to access and rivet the materials together within the access points.

A die table 30 is disposed on the frame 12 and supported by the nose 16 of the frame 12. As illustrated, the die table 30 has a first die 32 and a second die 34 disposed thereon. However, the die table 30 may have more or less than two dies disposed thereon. Each die on the die table 30 may have a different geometry. The first die 32 is positioned in-line with the punch reciprocation path 22. The die table 30 is shown rotatable about an axis of rotation 36. The die table 30 and the dies 32, 34 are shown symmetrically spaced about the axis of rotation 36 with the axis of rotation 36 being parallel to the punch reciprocation path 22. However, the die table 30 and/or dies 32, 34 may be asymmetrical in relation to the axis of rotation 36. The die table 30 may also be pivotally coupled to the nose 16 or indexed linearly longitudinally, transversely, or in any combination, in relation to the nose 16.

A first shaft 40 connects to and extends from the die table 30. The first shaft 40 extends along the axis of rotation 36 of the die table 30 such that the die table 30 rotates about the first shaft 40. A first passage 42 is defined by the nose 16 of the frame 12. The first shaft 40 is at least partially disposed in the first passage 42. The first passage 42 may be a through hole, as illustrated in the figure, or a blind hole. The first passage 42 also extends along the axis of rotation 36 of the die table 30. The first passage 42 extends in a direction offset from the punch reciprocation path 22 which allows for a lesser reinforced nose 16 of the frame 12 as compared to a riveter that has a hole in-line with the punch reciprocation. A hole in-line with the punch reciprocation increases the amount of stress risers and generally requires a need to reinforce the frame of the riveter in the nose resulting in a larger nose and limiting the access of the tool.

A second shaft 46 is coupled to and extends from the first shaft 40 in a divergent direction. The second shaft 46 is at least partially disposed within a second passage 48. The second passage 48 is defined by the frame 12 and is in communication with and diverges from the first passage 42. The second passage 48 extends from the nose 16 into and through the central section 18 of the frame 12. The divergent direction of the second shaft 46 and second passage 48 from the first shaft 40 and first passage 42, respectively, are illustrated as being generally perpendicular. Generally, perpendicular means angles ranging from 85 to 95 degrees. However, any angle of diversion greater than zero between the shafts 40, 46 and passages 42, 48 may be used so long as the second shaft 46 and second passage 48 extend out and away from the nose 16 of the frame 12.

An actuator 52 is connected to and supported by the central section 18 of the frame 12. Locating the actuator 52 away from the nose 16, as opposed to having an indexing motor located on the nose 16 of the frame 12, decreases the size of the nose 16 and increases the accessibility of the tool into access points of materials to be joined. The actuator 52 is connected to the second shaft 46. The actuator 52 rotates the second shaft 46, which rotates the first shaft 40 to rotate the die table 30. Alternatively, the die table 30 may be indexed in a non-rotating manner, such as transversely across the nose 16 of the frame 12 or longitudinally in and out from the nose 16 of the frame 12. The actuator 52 may index the die table 30 through the first and second passages 42, 48 rotatably, pivotally, linearly longitudinally, linearly transversely, or in any combination, in relation to the nose 16 of the frame 12.

A controller 56 actuates the actuator 52 via an actuation signal 58. The controller reciprocates the punch 20 through a reciprocation signal 60. In response to a reciprocation signal 60 from the controller, the punch 20 drives a self-piercing rivet into the materials to be joined. The self-piercing rivet is then influenced by the first die 32 and the tail end of the rivet flares and interlocks into the bottom sheet as defined by the first die 32. The controller may send an actuation signal 58 to the actuator 52 to rotate the die table 30 positioning the second die 34 in-line with the punch reciprocation path 22. The controller may also subsequently send a reciprocation signal 60 to the punch 20 and drive a self-piercing rivet into the materials to be joined with the tail end of the rivet being influenced by the second die 34.

The differing geometry of the second die 34 as compared to the first die 32 will result in the rivet having a different geometry within the materials to be joined. This may be useful when combining differing types of materials, combining differing thickness of materials, combining a differing number of materials, desiring differing stiffness or strength of joints and/or driving different sized rivets during a continuous manufacturing process. The self-piercing die riveter 10 may also be used in conjunction with a robotic arm 62 and the controller 56 may also control the robotic arm.

Figure 2:
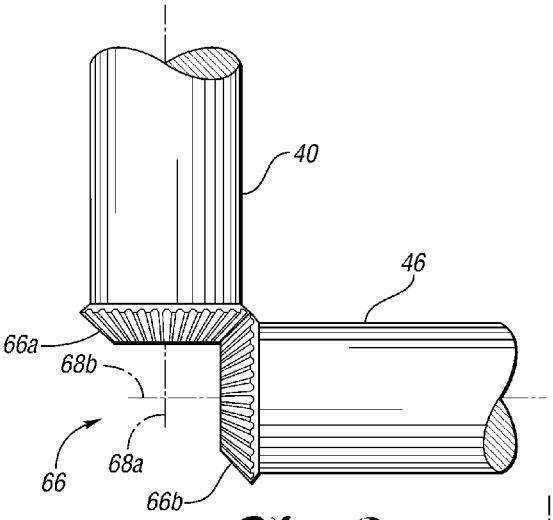
FIG. 2 is a partial side view of a first shaft coupled to a second shaft via a bevel gear set.

FIG. 2 shows the second shaft 46 coupled to the first shaft 40 by a bevel gear set 66. The bevel gear set 66 comprises a first bevel gear 66*a* disposed on an end of the first shaft 40 and a second bevel gear 66*b* disposed an end of the second shaft 46. The bevel gears 66*a*, 66*b* may be separate components connected to the ends of the shafts 40, 46, or machined directly into the end of the shafts 40, 46. As illustrated, the bevel gears 66*a*, 66*b* are miter gears with equal numbers of teeth and with axes at right angles; however, the bevel gears 66*a*, 66*b* may vary in size having a different number of teeth relative to each other and vary in angle between their respective axes. The bevel gears 66*a*, 66*b* are shown as straight bevel gears having straight teeth; however spiral bevel gears having curved teeth for a smoother and more gradual contact may also be used. The first and second shafts 40, 46 may have axes 68*a*, 68*b* that intersect, and thus the axes of the first and second passages 42, 48 may also be machined into the frame 12 to intersect. The bevel gear set 66 may alternatively use hypoid gears in which the axes 68*a*, 68*b* do not intersect, and thus the first and second passages 42, 48 may be machined into the frame 12 such that their respective axes do not intersect.

Figure 3:
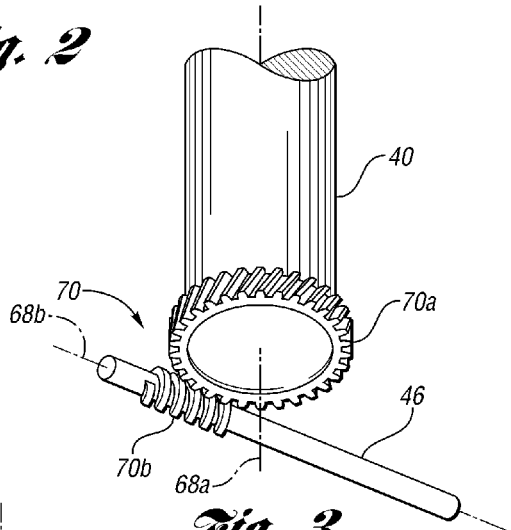
FIG. 3 is a partial perspective view of a first shaft coupled to a second shaft via a worm gear set.

FIG. 3 shows the second shaft 46 coupled to the first shaft 40 by a worm drive 70. The worm drive 70 comprises a worm gear 70*a* (also known as a worm wheel) disposed on an end of the first shaft 40 and a screw 70*b* (also known as a worm) disposed on an end of the second shaft 46. Alternatively, the worm gear 70*a* may be disposed on the second shaft 46 and the screw 70*b* may be disposed on the first shaft 40. The worm gear 70*a* and screw 70*b* may be separate components connected to the ends of the shafts 40, 46, or machined directly into the end of the shafts 40, 46. When using the worm drive 70, the first and second shafts 40, 46, axes 68*a*, 68*b* do not intersect, and thus the first and second passages 42, 48 axes may be machined such that their respective axes do not intersect.

Figure 4:
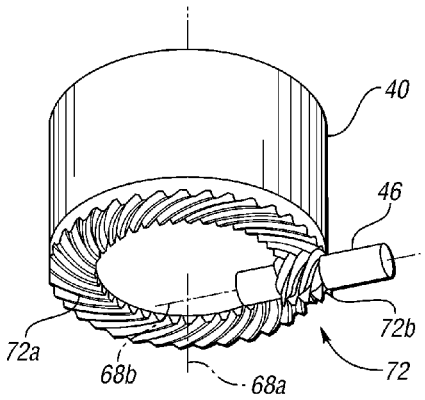
FIG. 4 is a partial perspective view of a first shaft coupled to a second shaft via a face worm gear set.

FIG. 4 shows the second shaft 46 coupled to the first shaft 40 by a face gear set 72. The face gear set 72 comprises a face gear 72*a* (also known as face wheel, crown gear, crown wheel, contrate gear or contrate wheel) disposed on an end of the first shaft 40 and a pinion 72*b* disposed on an end of the second shaft 46. Alternatively, the face gear 72*a* may be disposed on the second shaft 46 and the pinion 72*b* may be disposed on the first shaft 40. The face gear 72*a* and pinion 72*b* may be separate components connected to the ends of the shafts 40, 46, or machined directly into the end of the shafts 40, 46. The face gear set 72 may be configured such that the axes 68*a*, 68*b* of the shafts 40, 46 do or do not intersect, and thus the machining of the passages 42, 48 into the frame 12 may be done such that the axes of the passages do or do not intersect.

Figure 5:
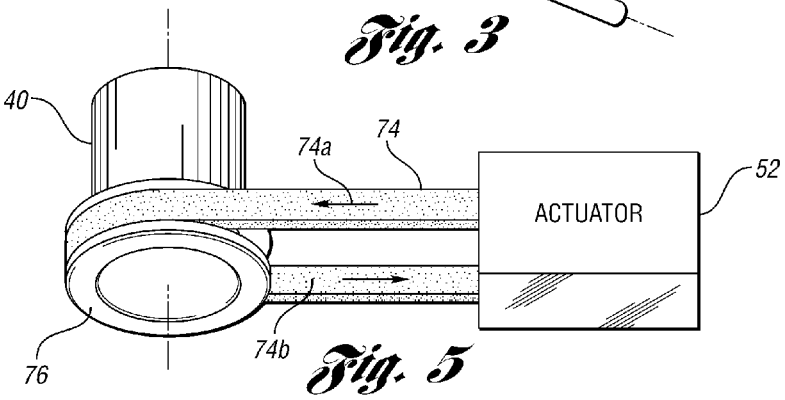
FIG. 5 is a partial perspective view of a belt coupled to a first shaft.

FIG. 5 shows the use of a belt 74 to couple the actuator 52 to the first shaft 40. The belt 74 may be a flat belt, round belt, or incorporate multi-grooves or ribs. The belt 74 may also be a chain of connected links. The belt 74 may be partially disposed in the second passage 48 of the frame 12. A third passage (not shown) may also be in communication with and extend from the first passage 42, such that a driving portion 74*a* of the belt 74 is partially disposed in the second passage 48 and a returning portion 74*b* of the belt 74 is partially disposed in the third passage, or vice versa. The actuator 52 may be multidirectional and the driving portion 74*a* may become the returning portion when the actuator 52 switches directions. The belt engages a pulley 76 disposed on the first shaft 40. The pulley 76 may also be a sprocket, cog, or spindle. The pulley 76 may be a separate component connected to the end of the first shaft 40 or machined directly into the end of the first shaft 40.

Figure 6:
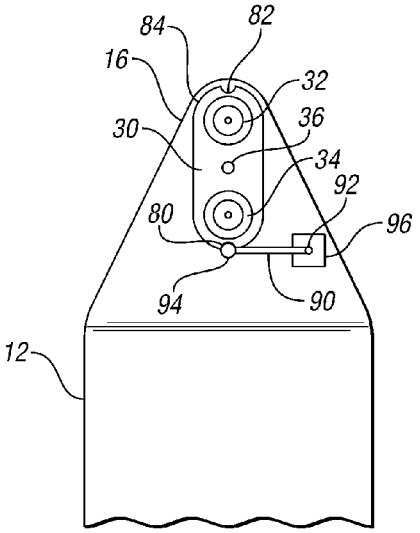
FIG. 6 is a partial top view of a nose of a frame of a self-piercing die riveter showing a die table with two dies and a locating arm having a distal end disposed in a detent for locating one of the two dies below a punch.

FIG. 6 shows a mechanism to inhibit/hinder rotation of the die table 30 and to locate the die table 30 in position. The die table 30 defines a first detent 80 and a second detent 82 on its peripheral edge 84. The first detent 80 is located opposite the axis of rotation 36 from the first die 32 and a second detent 82 is located opposite the axis of rotation 36 from the second die 34.

A locating arm 90 has a proximal end 92 connected to the frame 12 and a distal end 94, or free end, extending from the proximal end 92 and disposed in the first detent 80. The distal end 94 of the locating arm 90 is disposed in the first detent 80 of the die table 30 to position the first die 32 in-line with a reciprocating punch 20. Each detent 80, 82 corresponds to a respective die 32, 34 and the locating arm 90 is disposed in a detent 80, 82 to hinder rotation of the die table 30 and position its respective die 32, 34 in-line with the punch reciprocation path 22 (see FIG. 1).

The die table 30 is capable of being rotated from a first position in which the distal end 94 of the locating arm 90 is disposed in the first detent 80 to a second position in which the distal end 94 is disposed in the second detent 82, positioning the second die 34 in-line with the reciprocating punch 20. The actuator 52 may be used to rotate the die table 30 from a first position to a second position. The locating arm 90 may be fixed to the frame 12, in which the distal end 94 is selectively disposed in and out of the detents 80, 82 through elastic deformation of the locating arm 90. The distal end 94 of the locating arm 90 may be spherical to provide a ball and socket resistance in which the actuator 52 must overcome the resistance force to have the spherical end slide out of the first detent 80. The spherical end 94 then slides along the periphery 84 of the die table 30 until it springs back into the second detent 82. The locating arm 90 in cooperation with the detents 80, 82 provides for precision alignment of the dies 82, 84 as opposed to relying on the actuator 52 to align the dies 32, 34.

The locating arm 90 may also pivot at the proximal end 92 to allow the movement of the distal end 94 in and out of the detents 80, 82. A spring (not shown) may be used to bias the locating arm 90 into the detents 80, 82 and/or along the periphery 84 of the die table 30. A locating arm servo 96 may also be used to pivot the locating arm 90. The controller 56 may send a signal to the locating arm servo 96 to pivot the locating arm 90 away from the die table 30 when the die table 30 is actuated to rotate.

Figure 7:
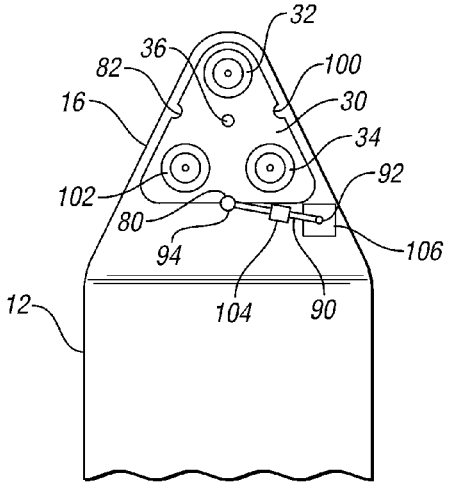
FIG. 7 is a partial top view of a nose of a frame of a self-piercing die riveter showing a die table with three dies and a locating arm having a distal end disposed in a detent for locating one of the three dies below a punch.

FIG. 7 shows another example of a die table 30 cooperating with the locating arm 90 The die table 30 defines a first detent 80 corresponding with a first die 32, a second detent 82 corresponding with a second die 34, and a third detent 100 corresponding with a third die 102. The locating arm 90 may be selectively disposed in one of the detents 80, 82, 100 to position its corresponding die 32, 34, 102 in-line with the punch reciprocation path 22 of the punch 20 (see FIG. 1). The locating arm 90 may have a manual adjuster 104 located between the proximal and distal ends 92, 94 to change the length of the locating arm 90 and provide for calibration of the placement of the dies. A second locating arm servo 106 may provide linear movement of the locating arm 90 at the proximal end 92 to provide for calibration and/or provide for differing location and orientation of detents 80, 82, 100 in the die table 30.

Figure 8:
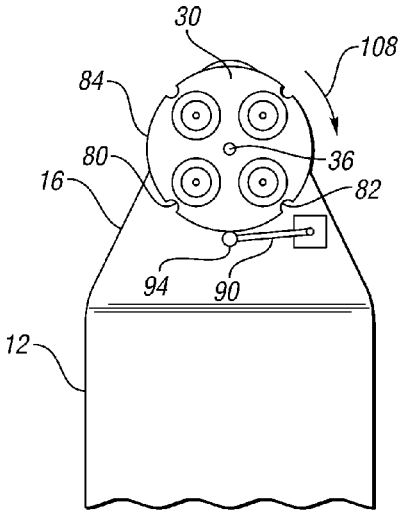
FIG. 8 is a partial top view of a nose of a frame of a self-piercing die riveter showing a die table with four dies and a locating arm having a distal end disposed outside of a detent while the die table is rotating.

FIG. 8 shows yet another example of a die table 30 cooperating with a locating arm 90. In this illustration, the distal end 94 of the locating arm 90 is not disposed in a detent. Rather, the distal end 94 is adjacent the peripheral edge 84 of the die table 30 between the first and second detents 80, 82, allowing the die table 30 to rotate about its axis of rotation 36 as indicated by arrow 108. Alternatively, the die table 30 may have a linear movement as provided by a coupling such as a rack and pinion configuration (not shown). In a linear movement configuration the locating arm 90 may be disposed in detents to hinder the linear movement of the die table 30.

The controller 56 is capable of positioning the self-piercing die riveter 10 between materials to be joined utilizing a robotic arm 62. The controller may send a reciprocation signal 60 to the punch 20 to reciprocate and punch a rivet into the materials to be joined. The locating arm 90 may hinder the movement of the die table 30 providing proper alignment of the first die 32 with the reciprocation path 22 of the punch 20. The controller 56 may then use the robotic arm 62 to reposition the riveter 10 to a different location on the materials to be joined. This different location may desire a different rivet geometry. The controller may then send an actuation signal 58 to the actuator 52 to index the die table 30 to provide a second die 34 in-line with the reciprocating path 22 of the punch 20. The locating arm 90 exits the detent 80 corresponding to the first die 82 and enters the detent 82 corresponding with the second die 34 to hinder the rotation of the die table and align the second die 34 in-line with the punch reciprocation path 22. The controller 56 may then send another reciprocation signal 60 to the punch 20 to reciprocate, resulting in a second rivet being placed into the materials to be joined having a different geometry than the first rivet. The controller 56 may be programmed to join materials autonomously on a mass-production assembly line. Utilizing innovations as described above increases the flexibility of the tool while maintaining tool access.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A self-piercing die riveter comprising:

a frame, secured to a robotic arm, supporting a die table having a plurality of dies, the frame defining a first passage extending along an axis of rotation of the die table and a second passage in communication with and diverging from the first passage; and an actuator, secured to the frame adjacent to the second passage, configured to rotate the die table through the first and second passages.

2. The riveter of claim 1, wherein the first passage extends in a direction offset from a reciprocating path of a punch and the second passage extends substantially perpendicularly from the first passage.

3. The riveter of claim 1, further comprising a first shaft connected to the die table and at least partially disposed in the first passage.

4. The riveter of claim 3, further comprising a second shaft coupling the actuator to the first shaft and at least partially disposed in the second passage.

5. The riveter of claim 4, wherein the second shaft is coupled to the first shaft through at least one of a bevel gear set, miter gear set, worm drive, and face gear set.

6. The riveter of claim 3, further comprising a belt at least partially disposed in the second passage coupling the actuator with the first shaft.

7. The riveter of claim 1, further comprising a locating arm having a proximal end connected to the frame and a distal end extending from the proximal end, wherein the die table defines a plurality of detents and the distal end of the locating arm is selectively disposed in a first of the plurality of detents to position a first of the plurality of dies in-line with a punch.

8. The riveter of claim 7, where the die table is capable of being rotated such that the distal end of the locating arm is selectively disposed in one of the plurality of detents to position a corresponding die of the plurality of dies in-line with the punch.

9. The riveter of claim 7, wherein the plurality of detents are notches located on a peripheral edge of the die table opposite the axis of rotation from the die.

10. The riveter of claim 7, wherein the locating arm is adjustable.

11. The riveter of claim 7, wherein the proximal end of the locating arm is fixed to the frame and the distal end of the locating arm is selectively disposed in and out of the plurality of detents through elastic deformation of the locating arm.

12. The riveter of claim 7, further comprising a controller in cooperation with the die table, actuator, and locating arm capable of rotating the die table to align at least one of the plurality of dies with punch.

13. A die riveter comprising:

a frame, having an internal portion and an external portion, secured to a robotic arm;

a die table rotatable on an axis and disposed on the internal portion of the frame;

a plurality of dies disposed on the die table;

a first shaft connected to and extending along the axis of the die table;

a second shaft coupled to and extending in a diverting direction from the first shaft; and an actuator, secured to an external portion of the frame, connected to the second shaft and capable of rotating the die table through the first and second shafts.

14. The riveter of claim 13, wherein the frame defines a first passage extending along the axis of the die table and the first shaft is at least partially disposed in the first passage, and the frame defines a second passage in communication with and diverging from the first passage and the second shaft is at least partially disposed in the second passage.

15. The riveter of claim 13, wherein the second shaft is coupled to the first shaft through at least one of a bevel gear set, miter gear set, worm drive, and face gear set.

16. The riveter of claim 13, further comprising a locating arm having a proximal end connected to the frame and a distal end extending from the proximal end, and the die table defines a plurality of detents each corresponding to one of the plurality of dies, wherein the distal end of the locating arm is selectively disposed in a first of the plurality of detents to position a first of the plurality of dies in-line with a reciprocating punch.

17. The riveter of claim 16, wherein the actuator is capable of rotating the die table from a first position in which the distal end of the locating arm is disposed in the first of the plurality of detents to a second position in which the distal end of the locating arm is disposed in a second of the plurality of detents and wherein the distal end of the locating arm in cooperation with the second of the plurality of detents hinder the rotation of the die table and position a second of the plurality of dies in-line with the punch.

18. A riveter comprising:

a C-shaped frame defining a head, a nose, and a central section disposed between the head and the nose, the C-shaped frame secured to a robotic arm at the central section;

a die table supported by the nose and defining a number of detents;

a first die disposed on the die table corresponding to a first detent of the number of detents;

a second die, having a geometry different than the first die, disposed on the die table corresponding to a second detent of the number of detents;

a locating arm connected to the riveter having a free end selectively disposable in the first and second detents to hinder indexing of the die table and position the first and second dies in-line with a path of a reciprocating punch, the reciprocating punch supported by the head; and an actuator supported by the central section, the actuator capable of indexing the die table advancing the free end of the locating arm to be selectively disposed in any one of the number of detents and position a corresponding die in-line with the path of the reciprocating punch.

19. The riveter of claim 18, wherein the number of detents consists of notches located on a peripheral edge of the die table.

* * * * *